US008011899B2

(12) United States Patent
Crider

(10) Patent No.: US 8,011,899 B2
(45) Date of Patent: Sep. 6, 2011

(54) COMPACT PUMP ARRANGEMENT

(75) Inventor: James A. Crider, Waterford, MI (US)

(73) Assignee: Metaldyne, LLC, Plymouth, MI (US)

( * ) Notice: Subject to any disclaimer, the term of this patent is extended or adjusted under 35 U.S.C. 154(b) by 978 days.

(21) Appl. No.: 11/809,361

(22) Filed: May 31, 2007

(65) Prior Publication Data

US 2008/0072850 A1 Mar. 27, 2008

Related U.S. Application Data

(60) Provisional application No. 60/809,763, filed on May 31, 2006.

(51) Int. Cl.
*F04B 17/00* (2006.01)

(52) U.S. Cl. ..... 417/362

(58) Field of Classification Search ..... 417/362
See application file for complete search history.

(56) References Cited

U.S. PATENT DOCUMENTS

| | | | | |
|---|---|---|---|---|
| 2,760,468 | A | 8/1956 | Dolza | |
| 2,820,441 | A | 1/1958 | Scheiterlein et al. | |
| 3,003,484 | A | 10/1961 | Rohrbacher et al. | |
| 3,792,697 | A | 2/1974 | Walter et al. | |
| 3,861,170 | A | 1/1975 | Asberg | |
| 3,934,966 | A | 1/1976 | Asberg | |
| 3,937,539 | A * | 2/1976 | Jones et al. | 384/571 |
| 4,715,780 | A | 12/1987 | Kan | |
| 4,768,923 | A * | 9/1988 | Baker | 415/230 |
| 4,955,786 | A | 9/1990 | Kunkel et al. | |
| 5,188,072 | A * | 2/1993 | Nolte et al. | 123/198 C |
| 5,355,847 | A * | 10/1994 | Ozeki | 123/41.44 |
| 5,540,192 | A | 7/1996 | Xanders | |
| 5,775,583 | A * | 7/1998 | Braatz et al. | 237/12.3 B |
| 5,795,137 | A * | 8/1998 | Ozawa et al. | 417/362 |
| 5,915,264 | A * | 6/1999 | White et al. | 711/168 |
| 6,120,243 | A * | 9/2000 | Tanabe | 415/112 |
| 6,363,918 | B2 * | 4/2002 | Håkansson et al. | 123/509 |
| 6,497,565 | B2 * | 12/2002 | Inaguma et al. | 418/259 |
| 6,638,015 | B2 * | 10/2003 | Ozawa et al. | 415/168.2 |
| 6,843,209 | B2 | 1/2005 | Miyagawa et al. | |
| 6,960,066 | B2 | 11/2005 | Koga et al. | |
| 6,978,742 | B2 | 12/2005 | Miyagawa et al. | |
| 7,618,338 | B2 * | 11/2009 | Greenwood | 474/93 |
| 2002/0034438 | A1 * | 3/2002 | Ozawa et al. | 415/111 |

* cited by examiner

*Primary Examiner* — Charles G Freay
(74) *Attorney, Agent, or Firm* — McDonald Hopkins LLC

(57) ABSTRACT

A compact water pump assembly has a shaft extending from a first end to a second end. An annular groove is located on the shaft. A housing member is located about the shaft and intermediate the first and second ends. An impeller is coupled to the second end of the shaft. A plurality of bearing members are arranged in a single-row within the groove. The bearing members rotatably support the shaft in the housing. In addition, each bearing member includes a radial centerline. A pulley is coupled to the first end of the shaft. The pulley is capable of engaging a drive belt such that the centerline of the belt driving surface is in substantial alignment with the bearing centerlines.

19 Claims, 3 Drawing Sheets

COMPACT PUMP ARRANGEMENT

CROSS-REFERENCE TO RELATED APPLICATION

This non-provisional patent application claims the benefit of U.S. Provisional Patent Application No. 60/809,763, entitled "COMPACT PUMP ARRANGEMENT," filed May 31, 2006, which is hereby incorporated in its entirety.

FIELD OF THE INVENTION

The present invention relates generally to compact pump arrangements, and more particularly, to compact water pumps for automobile engines.

BACKGROUND

Pumps are utilized in a wide variety of systems and assemblies to displace liquids, gases, slurries, and the like. One such system that utilizes a pump is a cooling system of an automobile engine. Automobile engine cooling systems typically include a pump, commonly referred to as a "water pump," to pump antifreeze, or other similar coolants, around and through the automobile engine to cool the engine during operation.

A common water pump 1 is schematically illustrated in FIG. 1. A water pump 1 is typically a centrifugal pump driven by a drive belt 2 connected to the crankshaft 3 of the engine. The water pump 1 includes a pulley 4, a center shaft 5, an impeller 6, and a bearing assembly 7. The pulley 4 and impeller 6 are coupled to opposite ends of the center shaft 5. The drive belt 2 is connected to the pulley 4 such that the pulley 4 rotates as the crankshaft 3 of the engine rotates. The coupling of the pulley 4 and the impeller 6 to the center shaft 5 causes the shaft 5 and impeller 6 to rotate as the pulley 4 rotates. The center shaft 5 is supported by the bearing assembly 7, which generally secures the shaft 5 while allowing the shaft 5 to rotate about its longitudinal axis $A_l$. The bearing assembly 7 is positioned to contact the center shaft 5 at a location between the pulley 4 and the impeller 6. The illustrated bearing assembly 7 is a double-row bearing assembly. In other words, the bearing assembly 7 includes first and second sets or rows of bearing elements 8 and 9, respectively, to secure the center shaft 5. The bearing assembly 7 is typically secured in a housing (not shown in FIG. 1), which may be used to secure the water pump 1 within the engine.

Prior art arrangements for water pumps, such as that shown in FIG. 1, may be difficult to incorporate into automobile engines due to the overall size of the water pump. As some automobiles are designed to be more compact and increasingly include features such as front wheel drive, available space in and around the engine becomes increasingly scarce. Therefore, there is a need in the art for arrangements of water pumps that reduce the overall size of the pump. Such reductions in size may increase the flexibility in which a water pump may be packaged into an automobile engine. Similarly, a reduction in the size of any pump may lead to greater flexibility in positioning the pump within its operational environment.

SUMMARY OF THE INVENTION

An embodiment of the present invention provides a compact water pump assembly. The assembly includes a shaft having a first end and a second end. An annular groove is located on the shaft. A housing member is located about the shaft and intermediate the first and second ends. An impeller is coupled to the second end of the shaft. A plurality of bearing members are arranged in a single-row within the groove. The bearing members rotatably support the shaft in the housing. In addition, each bearing member includes a radial centerline. A pulley is coupled to the first end of the shaft. The pulley is capable of engaging a drive belt such that the centerline of the belt driving surface is in substantial alignment with the bearing centerlines.

BRIEF DESCRIPTION OF THE SEVERAL VIEWS OF THE DRAWING

Objects and advantages together with the operation of the invention may be better understood by reference to the following detailed description taken in connection with the following illustration, wherein.

DETAILED DESCRIPTION OF THE INVENTION

The above-identified disadvantages of the prior art are overcome through the use of the invention disclosed herein. By reducing the overall size of a pump, the pump may be more readily packaged into an appropriate environment. In one embodiment, the reduction of the overall size of a water pump may allow the water pump to be more readily packaged into an automobile engine compartment.

Figure 1:
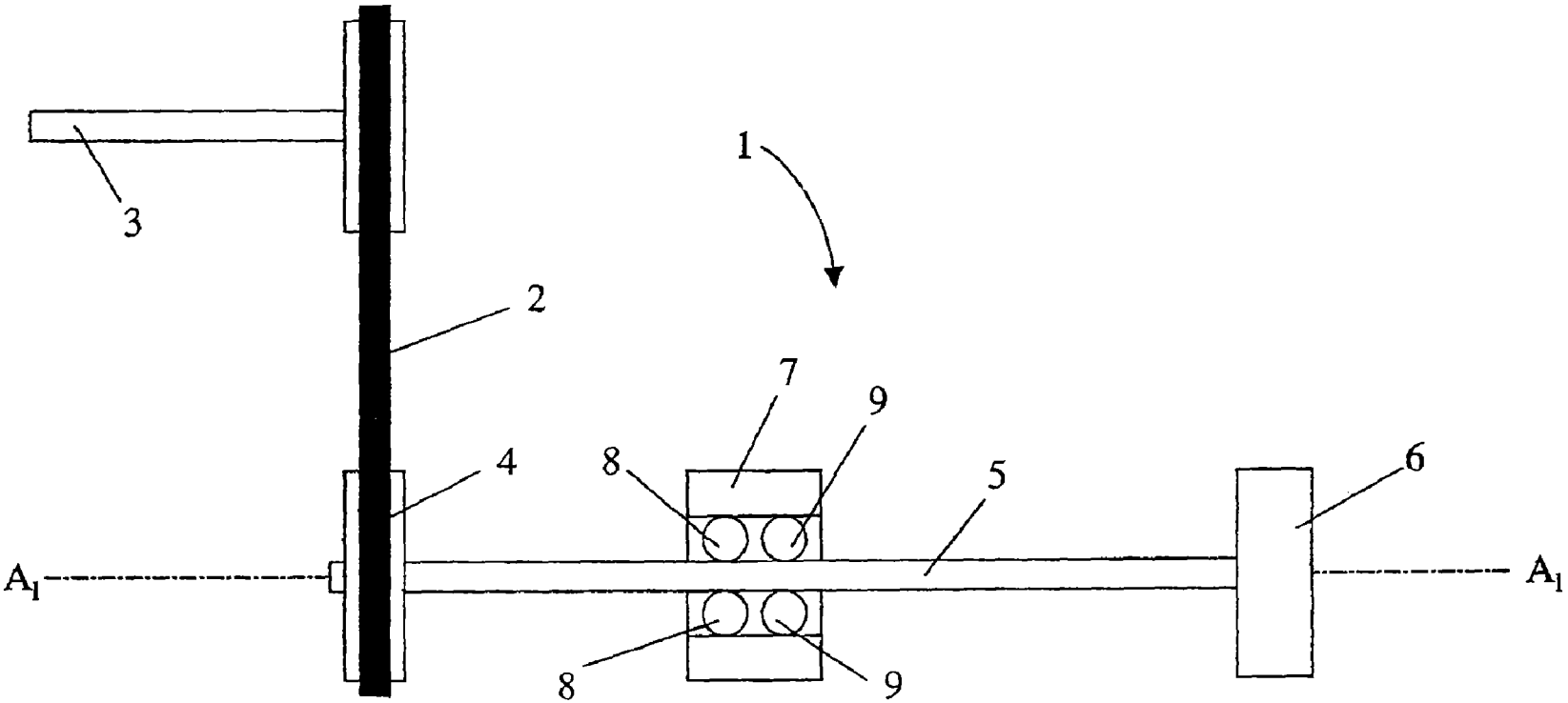
Figure 1 Prior Art
FIG. 1 is a schematic illustration of a prior art water pump including a double-row bearing assembly.
Figure 2:
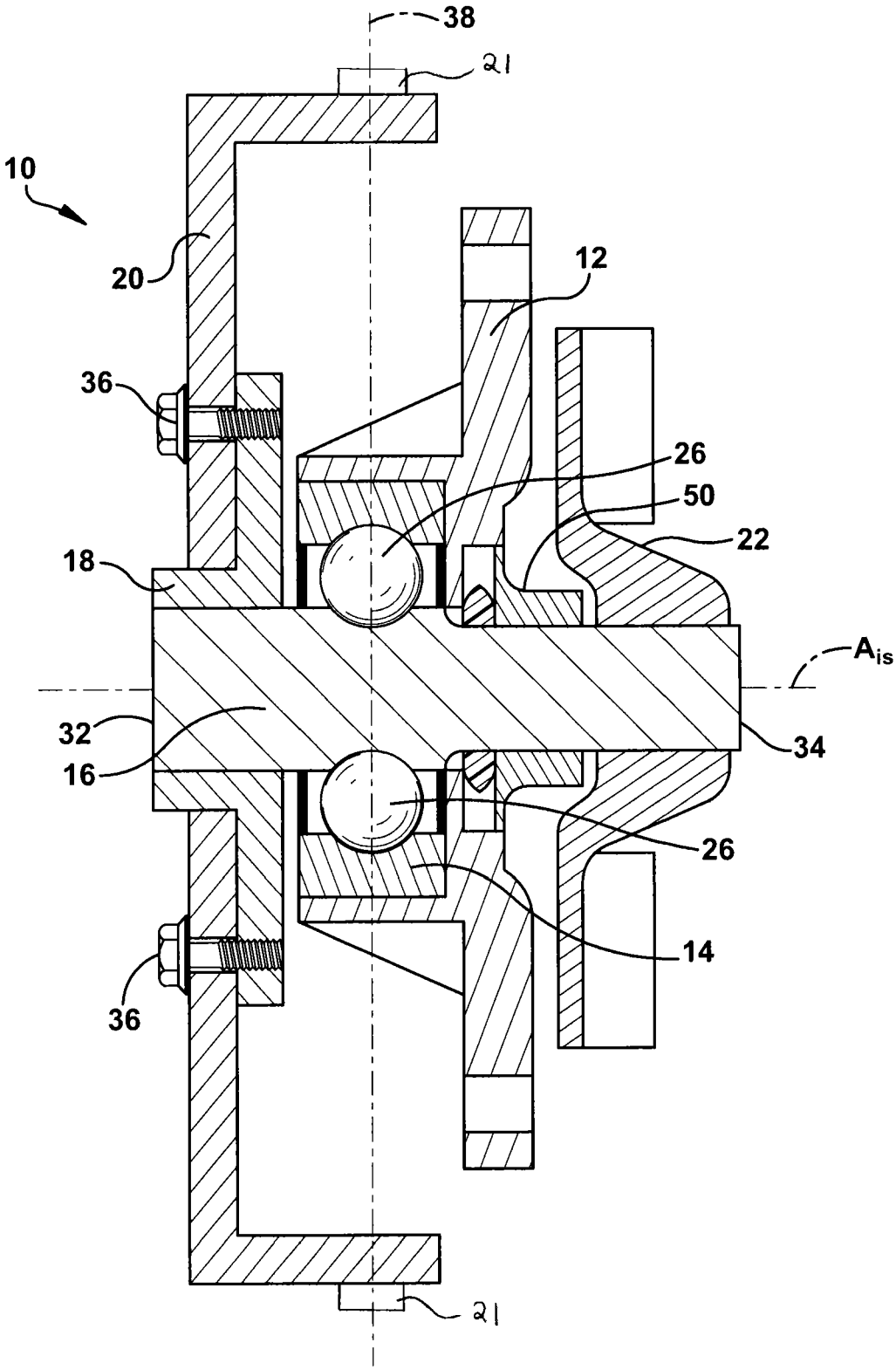
FIG. 2 is a cross-sectional view of an embodiment of a water pump in accordance with the present invention.

Referring to FIG. 2, an exemplary embodiment of a pump in accordance with the present invention is illustrated. The pump may be a water pump 10 for use in an automobile engine. The water pump 10 may include a housing 12, a bearing assembly 14, a shaft 16, a hub 18, a pulley 20, and an impeller 22. The bearing assembly 14 may be press-fit into the housing 12 to secure and position the bearing assembly 14 with respect to the housing 12. The bearing assembly 14 may be in contact with the shaft 16 to fix the position of or otherwise secure the shaft 16 with respect to the bearing assembly 14. The shaft 16 may include a generally circular cross-section and may be positioned to rotate about its longitudinal axis $A_{is}$. In an embodiment, the shaft 16 may be integrally formed with the hub 18.

Figure 3:
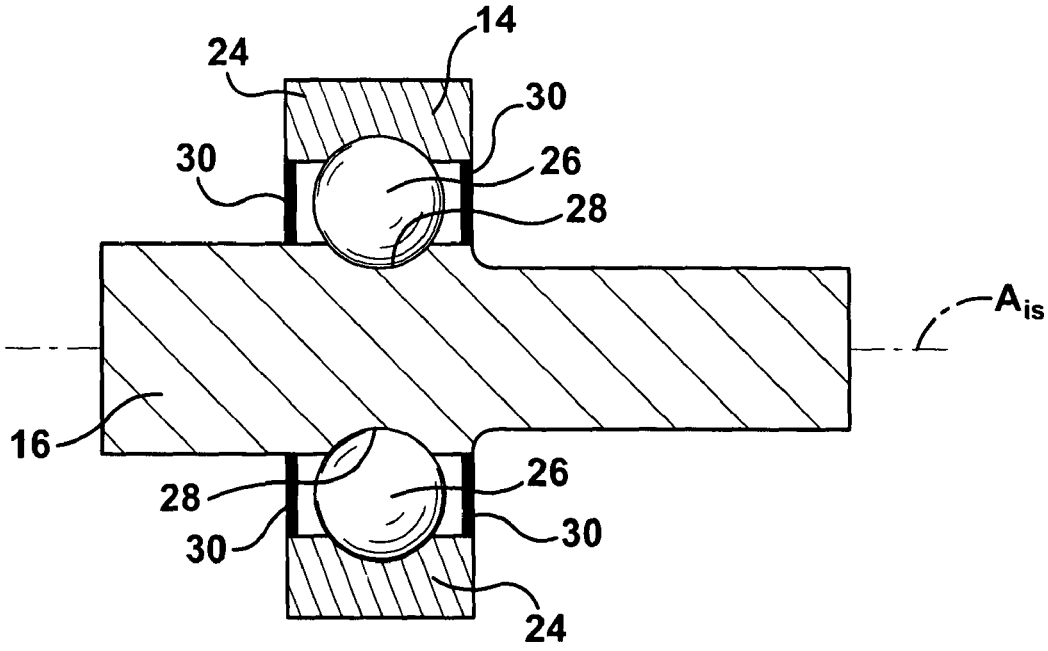
FIG. 3 is a cross-sectional view of the bearing assembly and integral shaft of the water pump of FIG. 2.

FIG. 3 illustrates the bearing assembly 14 in relation to the shaft 16 in one embodiment of the invention. As shown, the bearing assembly 14 may be a single-row bearing assembly. The bearing assembly 14 may be generally circular in cross-section to position the circular shaft 16 therein. The bearing assembly 12 may include an outer race 24, which contains a plurality of bearing members 26. The outer race 24 may be a groove corresponding in size and shape to the bearing members 26. While the exemplary embodiment is described as including a single-row bearing assembly with the bearing members 26, it will be readily understood that a wide variety of load bearing assemblies and elements may be utilized in the practice of this invention. For example, the bearings may be ball elements, such as, ball bearings, cylindrical roller bearings, needle roller bearings, tapered roller bearings, and the like. The bearing members 26 may all serve as load bearing assemblies and elements in the practice of this invention.

The shaft 16 may have an annular groove 28 along its outer surface that may correspond in shape and size to the bearing members 26. In one embodiment, the shaft 16 may be positioned such that the annular groove 28 serves as the inner race of the bearing assembly 14 and/or the bearing members 26. The plurality of bearing members 26 may fit into the groove 28 to maintain the position of the shaft 16 and/or the bearing members 26 relative to the housing 12. The annular groove 28 may have a arcuate cross-section, as shown in FIG. 3, a substantially V-shaped cross-section, a substantially U-shaped cross-section, a substantially square cross-section (i.e. having two spaced apart, substantially parallel walls joined together by an intermediate, substantially perpendicular wall), or any other cross-section corresponding in shape and size to the bearing members 26. Of course, other cross-sections suitable for engagement with the bearing members 26 are contemplated will be appreciated by one of ordinary skill in the art.

In an embodiment, the bearing members 26 may maintain the lateral and the longitudinal position of the shaft 16 while permitting the shaft 16 to rotate about a longitudinal axis $A_{is}$ extending therethrough. To facilitate the rotation of the shaft 16, the bearing assembly 14 may be packed and/or coated with lubricant, which may be contained within the bearing assembly 14 by, for example, seals 30 located at the outer ends of the bearing assembly 14. Additionally, spacers (not shown) may be employed between each bearing member 26 to prevent the bearing members 26 from concentrating in one specific area within the groove 28.

Referring again to FIG. 2, in one embodiment, the hub 18 may be press-fit at a first end 32 of the shaft 16, and the impeller 22 may be press-fit at a second end 34 of the shaft 16. A mechanical seal 50 may be disposed between the shaft 16 and the portion of the housing 12 adjacent to the impeller 22 to prevent entry of coolant from the pump chamber of the engine block into the bearing assembly 14. The pulley 20 may be coupled to the hub 18 by a plurality of bolts 36 or other such fasteners. A drive belt 21 may connect the pulley 20 with the crankshaft of the engine such that when the crankshaft rotates, the pulley 20 rotates. In a preferred embodiment, the pulley 20 is arranged such that the centerline of the drive surface of the drive belt 21 is in substantial alignment with the centerline 38 of the bearing assembly 14, and specifically, the radially extending centerlines 38 of each ball element 26.

By utilizing a single-row bearing 14 rather than the double-row bearing used in the prior art, the overall length, from the first end 32 of the shaft 16 to the second end 34 of the shaft 16, may be reduced. This reduction in length may reduce the forces translated or transferred to the water pump from to the drive belt 21 and the pulley. The drive belt 21 is typically drawn tightly around the pulley and driveshaft to resist and prevent slippage as the belt 21 rotates about the pulley and crankshaft. The drive belt 21 and pulley arrangement of the present invention may result in a force vector in line with and/or substantially parallel to the drive belt 21. The force of the drive belt 21, along with any additional forces due to the rotation of the pulley by the drive belt 21, may create normal and torque forces on the water pump. Advantageously, the shorter shaft length may reduce torque forces experiences by the water pump due to the drive belt 21. In addition, the positioning of the drive belt 21 in line with or substantially parallel to the centerline of the bearing elements places the drive belt 21 force vector in line with the bearing elements. This arrangement may further reduce the effects of forces on the water pump due to the arrangement and orientation of the drive belt 21.

As an example of the reduction of overall length of a water pump 10, a 27 millimeter wide double-row bearing assembly may be replaced by a 14 millimeter wide single-row bearing assembly. The inclusion of this single-row bearing assembly in place of the double-row bearing assembly may, for example, reduce the overall length of a shaft by 13 millimeters, from 66 millimeters to 53 millimeters. The reduction of length by 13 millimeters may increase the flexibility of packaging the water pump into an automobile engine. In addition, although the exemplary embodiment is described as a water pump 10, it will be readily understood by those skilled in the art that the practice of this invention can include a wide variety of pumps and other assemblies that rely on transfer of rotation force though pulley-to-belt or other similar arrangements.

While the invention has been described with reference to the preferred embodiment, other embodiments, modifications, and alternations may occur to one skilled in the art upon reading and understanding of this specification and are to be covered to the extent that they fall within the scope of the appended claims. Indeed, the invention as described by the claims is broader than and unlimited by the preferred embodiment, and the terms in the claims have their full and ordinary meaning.

What is claimed is:

1. A compact water pump assembly comprising:

a shaft having a first end and a second end;

an annular groove in said shaft;

a housing member located about said shaft and intermediate said first end and said second end;

an impeller coupled to said second end;

a plurality of bearing members arranged in a single-row within said annular groove and rotatably supporting said shaft in said housing, each of said bearing members having a radial centerline; and a pulley coupled to said first end and capable of engaging a drive belt such that the centerline of the drive belt is in substantial alignment with at least one of said centerlines of said bearing members wherein said pump does not include bearing members in contact with said shaft other than said bearing members arranged in a single-row.

2. The compact water pump assembly of claim 1 wherein said annular groove has a radial centerline in substantial alignment with said bearing centerlines.

3. The compact water pump assembly of claim 2 wherein said annular groove has an arcuate cross-section.

4. The compact water pump assembly of claim 2 wherein said annular groove corresponds in size and shape to the bearing members.

5. The compact water pump assembly of claim 1 wherein said bearing members are ball bearings.

6. The compact water pump assembly of claim 1 further comprising:

a hub positioned between said shaft and said pulley wherein said hub is integrally formed with said shaft.

7. The compact water pump assembly of claim 1 further comprising:

a mechanical seal positioned between said housing and said bearing members capable of preventing fluid communication into said bearing members.

8. The compact water pump assembly of claim 1 further comprising:

an annular outer race in said housing member, said annular outer race sized and shaped to receive said bearing members.

9. The compact water pump assembly of claim 8 wherein said outer race has a radial centerline in substantial alignment with at least one of said bearing centerlines.

10. A compact water pump assembly comprising:

a shaft having a first end and a second end;

an annular groove in said shaft;

a housing member located about said shaft and intermediate said first end and said second end;

an impeller coupled to said second end;

a plurality of bearing members arranged in a single-row within said annular groove and rotatably supporting said shaft in said housing, each of said bearing members having a radial centerline;

a pulley coupled to said first end; and a belt in driving engagement with said pulley, said belt having a centerline in substantial alignment with said bearing centerlines wherein said pump does not include bearing members in contact with said shaft other than said bearing members arranged in a single-row.

11. The compact water pump assembly of claim 10 wherein said annular groove has a radial centerline in substantial alignment with at least one of said bearing centerlines.

12. The compact water pump assembly of claim 10 wherein said annular groove has an arcuate cross-section.

13. The compact water pump assembly of claim 10 wherein said bearing members are ball bearings.

14. The compact water pump assembly of claim 10 further comprising:

a mechanical seal positioned between said housing and said bearing members capable of preventing fluid communication into said bearing members.

15. The compact water pump assembly of claim 10 wherein said annular groove corresponds in shape and size to said bearing members.

16. The compact water pump assembly of claim 10 further comprising:

a hub positioned between said shaft and said pulley wherein said hub is connected to said shaft.

17. The compact water pump assembly of claim 16 further comprising:

an outer race formed in said hub, said outer race shaped and sized to receive said bearing members.

18. The compact water pump assembly of claim 10 further comprising:

an annular outer race in said housing member, said annular outer race sized and shaped to receive said bearing members.

19. The compact water pump assembly of claim 18 wherein said outer race has a radial centerline in substantial alignment with at least one of said bearing centerlines.

* * * * *